US007709416B2

(12) United States Patent
Iida et al.

(10) Patent No.: US 7,709,416 B2
(45) **Date of Patent: *May 4, 2010**

(54) HEAT-SENSITIVE RECORDING MATERIAL

(75) Inventors: Takeshi Iida, Amagasaki (JP); Takeshi Shikano, Amagasaki (JP)

(73) Assignee: OJI Paper Co., Ltd., Tokyo (JP)

( * ) Notice: Subject to any disclaimer, the term of this patent is extended or adjusted under 35 U.S.C. 154(b) by 404 days.

This patent is subject to a terminal disclaimer.

(21) Appl. No.: 11/666,344

(22) PCT Filed: Nov. 1, 2005

(86) PCT No.: PCT/JP2005/020120

§ 371 (c)(1),
(2), (4) Date: Apr. 26, 2007

(87) PCT Pub. No.: WO2006/049175

PCT Pub. Date: May 11, 2006

(65) Prior Publication Data

US 2008/0103041 A1 May 1, 2008

(30) Foreign Application Priority Data

Nov. 5, 2004 (JP) ..... 2004-322023
May 24, 2005 (JP) ..... 2005-150282

(51) Int. Cl.
*B41M 5/42* (2006.01)

(52) U.S. Cl. ..... 503/207; 503/200; 503/226

(58) Field of Classification Search ..... None
See application file for complete search history.

(56) References Cited

U.S. PATENT DOCUMENTS

| | | | | |
|---|---|---|---|---|
| 4,513,301 | A * | 4/1985 | Takayama et al. | 503/200 |
| 6,656,880 | B2 * | 12/2003 | Aono | 503/207 |
| 2002/0058590 | A1 | 5/2002 | Aono | 503/226 |

FOREIGN PATENT DOCUMENTS

| | | | |
|---|---|---|---|
| JP | 59-106995 | A | 6/1984 |
| JP | 1-214472 | A | 8/1989 |
| JP | 5-69662 | A | 3/1993 |
| JP | 5-96849 | A | 4/1993 |
| JP | 5-147354 | A | 6/1993 |
| JP | 7-9762 | A | 1/1995 |
| JP | 7-505589 | A | 6/1995 |
| JP | 7-232477 | A | 9/1995 |
| JP | 8-197848 | A | 8/1996 |
| JP | 8-230323 | A | 9/1996 |
| JP | 10-857 | A | 1/1998 |
| JP | 11-314454 | A | 11/1999 |
| JP | 2000-118138 | A | 4/2000 |
| JP | 2000-238432 | A | 9/2000 |
| JP | 2001-191643 | A | 7/2001 |
| JP | 2002-52830 | A | 2/2002 |
| JP | 2002-178647 | A | 6/2002 |
| JP | 2002-240430 | A | 8/2002 |
| JP | 2003-34083 | A | 2/2003 |
| JP | 2003-191647 | A | 7/2003 |
| JP | 2004-223994 | A | 8/2004 |
| JP | 2004-284029 | A | 10/2004 |
| JP | 2004-358762 | A | 12/2004 |

* cited by examiner

*Primary Examiner*—Bruce H Hess
(74) *Attorney, Agent, or Firm*—Kubovcik & Kubovcik

(57) ABSTRACT

The present invention provides a heat-sensitive recording material that comprises a support, a heat-sensitive recording layer comprising a leuco dye and a developer, and a protective layer principally comprising a pigment and a binder. The support, the heat-sensitive recording layer, and the protective layer are provided in this order. The protective layer comprises: (1) a pigment of secondary particles with an average particle diameter of 30 to 900 nm formed by aggregation of amorphous silica primary particles with a particle diameter of 3 to 70 nm; or (2) a pigment of secondary particles with an average particle diameter of 30 to 900 nm formed by aggregation of amorphous silica primary particles with a particle diameter of 3 to 70 nm, and a binder comprising acetoacetyl modified polyvinyl alcohol with a saponification degree of 90 to 100 mol % and a polymerization degree of 1900 to 5000.

18 Claims, No Drawings

HEAT-SENSITIVE RECORDING MATERIAL

This application is a 371 of international application PCT/JP2005/020120, which claims priority based on Japanese patent application Nos. 2004-322023 and 2005-150282 filed Nov. 5, 2004, and May 24, 2005, respectively, which are incorporated herein by reference.

TECHNICAL FIELD

The present invention relates to a heat-sensitive recording material comprising a heat-sensitive recording layer and a protective layer that utilizes the color forming reaction between a leuco dye and a developer.

BACKGROUND ART

Heat-sensitive recording materials are well-known, which utilize the color forming reaction between a leuco dye and a developer to produce recorded images by heat. Such heat-sensitive recording materials are relatively inexpensive, and the recording apparatuses therefor are compact and easily maintained. For these reasons, heat-sensitive recording materials have found a wide range of uses: they are used not only as recording media for the output of facsimiles and a variety of computers, printers of scientific measuring equipment, etc., but also as recording media for a variety of printers of POS labels, ATMs, CAD, handy terminals, paper for various tickets, etc.

When, however, such heat-sensitive recording materials come into contact with oil, and plasticizers such as films or the like, alcohol, water, etc., problems occur such as fading of the color of recorded images, background coloration, adhesion of residue to the thermal-recording head during recording and the like.

In order to avoid such problems, a heat-sensitive recording layer has previously had thereon a protective layer composed of, e.g., a water-soluble resin such as polyvinyl alcohol, starch, acrylic resin or the like and a pigment such as kaolin, calcium carbonate, amorphous silica, colloidal silica or the like (see Patent Documents 1 to 7). Pigments such as calcium carbonate and amorphous silica have particularly been used for preventing the adhesion of residue to the thermal head. For example, a heat-sensitive recording material comprising a protective layer principally composed of a resin and a filler with a Mohs hardness of 2.0 or less has been proposed which does not cause thermal-head wear and has less adhesion of residue to the thermal head (see Patent Document 1).

In recent years, heat-sensitive recording materials have frequently been used as printed ticket forms and like printed matter. Printing with ultraviolet curable ink, in particular, has been widely used, since it offers advantages as follows:

(1) Solvent-free, therefore safety guaranteed (2) Fast drying speed due to ultraviolet drying (3) Energy savings achieved by compact UV irradiators (4) Lowered drying temperature that leads to less background fogging by heat, especially in heat-sensitive recording materials However, protective layers with satisfactory properties have yet to be attained, because conventional protective layers present problems as follows:

(a) Low adhesion of ink to heat-sensitive recording materials causes printed surfaces to be easily removed by, for example, cellophane tape.

(b) During recording with a thermal head, ink fuses by heat and adheres to the thermal head, easily causing a sticking phenomenon.

(c) The thickness of an ink layer printed on the surface of the protective layer of a heat-sensitive recording layer attenuates the recording energy from the thermal head, resulting in lowered recording sensitivity.

Moreover, heat-sensitive recording layers are used in places that require quietness, such as medical institutions, libraries and the like. In such places, the generation of a loud noise during printing (i.e., noise produced from sticking) is problematic, so that heat-sensitive recording materials substantially free from sticking are demanded. Furthermore, in the medical institutions where alcohols and medical creams are used, if heat-sensitive recording layers are touched by hands with such chemicals, background fogging occurs. In order to prevent such background fogging, heat-sensitive recording materials are demanded that have excellent barrier properties against chemicals such as alcohols, medical creams, etc., as well as barrier properties against plasticizers contained in medical files for storing the heat-sensitive recording materials.

Sticking is a phenomenon caused when material in close contact with the thermal head fuses or softens via recording energy, and attaches to the head. This sticking phenomenon causes problems such as the generation of noise during paper feed, skipping of recording (i.e., some portions are left unrecorded), and the like.

If materials with high heat resistance are used for forming protective layers to solve these problems, problems will occur such as the deterioration of film formation and lowered barrier properties against chemicals and plasticizers contained in medical files.

Moreover, if porous pigments such as calcium carbonate, silica and the like are used in protective layers in order to reduce sticking by absorbing the material fused or softened via recording energy, the anti-sticking properties will be improved, whereas the barrier properties will become poor. The use of porous pigments also significantly reduces the sensitivity when applied in large amounts to improve the barrier properties. Accordingly, it has been very difficult to obtain a high balance of anti-sticking properties, barrier properties, and recording sensitivity.

Furthermore, the use of acetoacetyl-modified polyvinyl alcohol in protective layers has been proposed in many literatures (see Patent Documents 8 to 12). However, it has been difficult to obtain a high balance of anti-sticking properties, barrier properties, and recording sensitivity.

Patent Document 1: Japanese Unexamined Patent Publication No. 1993-147354

Patent Document 2: Japanese Unexamined Patent Publication No. 1995-9762

Patent Document 3: Japanese Unexamined Patent Publication No. 2000-118138

Patent Document 4: Japanese Unexamined Patent Publication No. 2000-238432

Patent Document 5: Japanese Unexamined Patent Publication No. 2002-240430

Patent Document 6: Japanese Unexamined Patent Publication No. 2004-223994

Patent Document 7: Japanese Unexamined Patent Publication No. 2003-191647

Patent Document 8: Japanese Unexamined Patent Publication No. 1984-106995 (claim 1)

Patent Document 9: Japanese Unexamined Patent Publication No. 1995-232477 (claim 1)

Patent Document 10: Japanese Unexamined Patent Publication No. 1996-230323 (claim 2)

Patent Document 11: Japanese Unexamined Patent Publication No. 2004-284029 (claim 2)

Patent Document 12: Japanese Unexamined Patent Publication No. 2004-358762 (claim 3)

DISCLOSURE OF THE INVENTION

Problem to be Solved by the Invention

An object of the present invention is to provide a heat-sensitive recording material that exhibits reduced adhesion of residue to a thermal head, reduced sticking, high barrier properties against chemicals and high recording sensitivity.

Means for Solving the Problem

In an attempt to overcome the aforementioned problems, the present inventors conceived the use of non-crystalline silica, i.e., amorphous silica, or colloidal silica as a pigment for use in a protective layer, and conducted extensive research, thus obtaining the following findings.

(a) Colloidal silica used in the aforementioned prior art (Patent Documents 3 to 5) consists essentially of silica primary particles, and contains few secondary particles formed by aggregation of the silica primary particles. The formation of a protective layer using such colloidal silica does not result in sufficient voids; therefore, it has been difficult to obtain a heat-sensitive recording layer that exhibits desired levels of effects (particularly, reduction in the adhesion of residue to a thermal head, reduced sticking, etc.) (see Comparative Example I-2 described below).

(b) With respect to amorphous silica used in the aforementioned prior art (Patent Documents 1, 2, 6 and 7) for the prevention of residue adhesion and sticking, the use of calcium carbonate, silica or a like porous pigment in a protective layer for the purpose of reducing sticking improves the anti-sticking properties, but tends to result in poor barrier properties, lowered recording sensitivity, etc, as explained above.

(c) According to the studies conducted by the present inventors, the primary particles of the amorphous silica used in the prior art are typically from about 70 nm or less in diameter. Secondary particles formed by aggregation of the amorphous silica primary particles have an average particle diameter as large as 1 μm or more. This is probably why chemicals easily penetrate via the gaps formed by the use of such silica (in particular, the gaps between the silica secondary particles and the resin coating, voids in the secondary particles), resulting in lowered barrier properties.

(c) For these reasons, the present inventors pulverized conventional amorphous silica secondary particles to prepare silica having an average diameter of 30 to 900 nm, which is smaller than the average diameter of the secondary particles of 1 μm, and the resulting silica was used for a protective layer of a heat-sensitive recording material.

(d) As a result, the inventors found that when the silica having an average particle diameter of secondary particles of 30 to 900 nm is used for a protective layer, the resulting heat-sensitive recording material exhibits reduced adhesion of residue to the thermal head, reduced sticking during recording, high barrier properties against chemicals, and high recording sensitivity. The present invention was accomplished as a result of further research based on this finding.

Heat-sensitive recording materials as set forth in Items 1 to 12 below are provided in accordance with a preferred embodiment (first embodiment) of the present invention.

Item 1: A heat-sensitive recording material comprising a support, a heat-sensitive recording layer comprising a leuco dye and a developer, and a protective layer principally comprising a pigment and a binder; the support, the heat-sensitive recording layer, and the protective layer being provided in this order; the pigment in the protective layer being secondary particles with an average particle diameter of 30 to 900 nm formed by aggregation of amorphous silica primary particles with a particle diameter of 3 to 70 nm.

Item 2: A heat-sensitive recording material according to Item 1, wherein the secondary particles are present in a proportion of 1 to 40 mass % relative to total solids of the protective layer.

Item 3: A heat-sensitive recording material according to Item 1 or 2, wherein the protective layer further comprises at least one pigment selected from the group consisting of kaolin, light calcium carbonate, ground calcium carbonate, calcined kaolin, titanium oxide, magnesium carbonate, aluminum hydroxide, colloidal silica, synthetic layered mica and plastic pigments such as urea-formalin resin fillers and the like.

Item 4: A heat-sensitive recording material according to any of Items 1 to 3, wherein the binder in the protective layer comprises an acrylic resin, the acrylic resin being present in a proportion of 10 to 70 mass % relative to total solids of the protective layer.

Item 5: A heat-sensitive recording material according to Item 4, wherein the acrylic resin is a copolymer of (a) (meth) acrylonitrile and (b) a vinyl monomer copolymerizable with (meth)acrylonitrile.

Item 6: A heat-sensitive recording material according to Item 4, wherein the acrylic resin is a copolymer of (xi) at least one monomer selected from the group consisting of acrylonitrile and methacrylonitrile and (iii) at least one monomer selected from the group consisting of alkyl or hydroxyalkyl esters ($C_{1-10}$ alkyl or $C_{1-10}$ hydroxyalkyl esters, in particular) of acrylic acid and methacrylic acid, the copolymer having a glass transition temperature Tg of −10 to 100° C., or a copolymer of (xi) at least one monomer selected from the group consisting of acrylonitrile and methacrylonitrile, (iii) at least one monomer selected from the group consisting of alkyl or hydroxyalkyl esters ($C_{1-10}$ alkyl or hydroxyalkyl esters, in particular) of acrylic acid and methacrylic acid, (i) at least one monomer selected from the group consisting of acrylic acid and methacrylic acid, and (vi) at least one monomer selected from the group consisting of acrylamide, methacrylamide, N-methylolacrylamide, N-methylolmethacrylamide, and like acrylamide compounds, the copolymer having a glass transition temperature Tg of 30 to 100° C.

Item 7: A heat-sensitive recording material according to any of Items 4 to 6, wherein the binder of the protective layer further comprises a water-soluble resin.

Item 8: A heat-sensitive recording material according to Item 7, wherein the water-soluble resin is a polyvinyl alcohol or a modified polyvinyl alcohol, the polyvinyl alcohol or modified polyvinyl being present in a proportion of 25 to 600 mass % based on total solids of the acrylic resin.

Item 9: A heat-sensitive recording material according to Item 7, wherein the water-soluble resin is acetoacetyl-modified polyvinyl alcohol with a polymerization degree of 500 to 1800.

Item 10: A heat-sensitive recording material according to Item 7, wherein the water-soluble resin is diacetone-modified polyvinyl alcohol.

Item 11: A heat-sensitive recording material according to any of Items 1 to 10, wherein the heat-sensitive recording material has a printed portion.

Item 12: A heat-sensitive recording material according to any of Items 1 to 11, further comprising an undercoat layer between the support and the heat-sensitive recording layer.

In accordance with another preferred embodiment (second embodiment) of the present invention, heat-sensitive recording materials as set forth in Items 13 to 20 below are also provided.

Item 13: A heat-sensitive recording material comprising a support, a heat-sensitive recording layer comprising a leuco dye and a developer, and a protective layer principally comprising a pigment and a binder; the support, the heat-sensitive recording layer, and the protective layer being provided in this order; the pigment in the protective layer comprising secondary particles with an average particle diameter of 30 to 900 nm formed by aggregation of amorphous silica primary particles with a particle diameter of 3 to 70 nm; the binder of the protective layer comprising acetoacetyl-modified polyvinyl alcohol with a saponification degree of 90 to 100 mol % and a polymerization degree of 1900 to 5000.

Item 14: A heat-sensitive recording material according to Item 13, wherein the secondary particles are present in a proportion of 10 to 40 mass % relative to total solids of the protective layer.

Item 15: A heat-sensitive recording material according to Item 13, wherein the acetoacetyl-modified polyvinyl alcohol is present in a proportion of 30 to 80 mass % relative to total solids of the protective layer.

Item 16: A heat-sensitive recording material according to any of Items 13 to 15, wherein the protective layer further comprises an acrylic resin in a proportion of 5 to 40 mass % relative to total solids of the protective layer.

Item 17: A heat-sensitive recording material according to Item 16, wherein the acrylic resin is a copolymer of (xi) at least one monomer selected from the group consisting of acrylonitrile and methacrylonitrile; and (iii) at least one monomer selected from the group consisting of alkyl or hydroxyalkyl esters ($C_{1-10}$ alkyl or $C_{1-10}$ hydroxyalkyl esters, in particular) of acrylic acid and methacrylic acid, the copolymer having a glass transition temperature (Tg) of −10 to 100° C., or a copolymer of (xi) at least one monomer selected from the group consisting of acrylonitrile and methacrylonitrile, (iii) at least one monomer selected from the group consisting of alkyl or hydroxyalkyl esters ($C_{1-10}$ alkyl or hydroxyalkyl esters, in particular) of acrylic acid and methacrylic acid, (i) at least one monomer selected from the group consisting of acrylic acid and methacrylic acid, and (vi) at least one monomer selected from the group consisting of acrylamide, methacrylamide, N-methylolacrylamide, N-methylolmethacrylamide, and like acrylamide compounds, the copolymer having a glass transition temperature Tg of 30 to 100° C.

Item 18: A heat-sensitive recording material according to any of Items 13 to 17, wherein the protective layer further comprises zinc stearate in a proportion of 2 to 7.5 mass % relative to total solids of the protective layer.

Item 19: A heat-sensitive recording material according to any of Items 13 to 18, wherein the coating amount of the protective layer is 0.3 to 2.5 g/m$^2$.

Item 20: A heat-sensitive recording material according to any of Items 13 to 19, further comprising an undercoat layer between the support and the heat-sensitive recording layer.

EFFECTS OF THE INVENTION

The heat-sensitive recording material according to the invention exhibits highly reduced sticking during recording, high recording sensitivity, and high barrier properties against chemicals.

The heat-sensitive recording material according to the first embodiment is especially suitable for use as a record for tickets or the like, when printed and it exhibits excellent ink fastness reduced adhesion of residue to the thermal head, reduced sticking of a printed portion to such an extent that substantially or practically no problems arise, high recording sensitivity, and high barrier properties against chemicals and plasticizers contained in files for use in the medical field.

The heat-sensitive recording material according to the second embodiment is especially suitable for use in places such as medical institutions, libraries, etc., and it exhibits reduction in sticking to such an extent that substantially or practically no problems arise, reduced adhesion of residue to the thermal head, high recording sensitivity, and barrier properties against chemicals such as alcohols and the like that are even higher than the barrier properties of the heat-sensitive recording material according to the first embodiment.

BEST MODE FOR CARRYING OUT THE INVENTION

The present invention will be described in detail below.

Support

In accordance with the first and second embodiments of the invention, the support for use in the heat-sensitive recording material can be selected from papers, coated papers whose surfaces are coated with pigments, latex and the like, multilayered synthetic papers made from polyolefin-based resins, plastic films, and composite sheets thereof.

Heat-Sensitive Recording Layer

In accordance with the first and second embodiments of the invention, various known leuco dyes, developers, sensitizers, pigments, binders, various auxiliaries and the like can be used to form a heat-sensitive recording layer.

The heat-sensitive recording layer of the invention typically comprises a known leuco dye, developer, and binder, and may optionally comprise a sensitizer, a pigment, various auxiliaries and the like.

Examples of preferable leuco dyes include triphenylmethane-, fluoran-, phenothiazine-, auramine-, spiropyran-, and indolylphthalide-based leuco dyes. Such leuco dyes may be used singly or in combination. Specific examples of leuco dyes include 3-(4-diethylamino-2-ethoxyphenyl)-3-(1-ethyl-2-methylindol-3-yl)-4-azaphthalide, Crystal violet lactone, 3-(N-ethyl-N-isopentylamino)-6-methyl-7-anilinofluoran, 3-diethylamino-6-methyl-7-anilinofluoran, 3-diethylamino-6-methyl-7-(o, p-dimethylanilino)fluoran, 3-(N-ethyl-N-p-toluidino)-6-methyl-7-anilinofluoran, 3-(N-ethyl-p-toluidino)-6-methyl-7-(p-toluidino)fluoran, 3-pyrrolidino-6-methyl-7-anilinofluoran, 3-di(N-butyl)amino-6-methyl-7-anilinofluoran, 3-di(N-butyl)amino-7-(o-chloroanilino)fluoran, 3-di(N-pentyl)amino-6-methyl-7-anilinofluoran, 3-(N-cyclohexyl-N-methylamino)-6-methyl-7-anilinofluoran, 3-diethylamino-7-(o-chloroanilino)fluoran, 3-diethylamino-7-(m-trifluoromethylanilino)fluoran, 3-diethylamino-6-methyl-7-chlorofluoran, 3-diethylamino-6-methylfluoran, 3-cyclohexylamino-6-chlorofluoran, 3-(N-ethyl-N-hexylamino)-6-methyl-7-(p-chloroanilino)fluoran, etc.

Developers can be used singly or in combination. Specific examples of developers include 4-hydroxy-4'-isopropoxydiphenylsulfone, 4-hydroxy-4'-allyloxydiphenylsulfone, 4,4'-isopropylidenediphenol, 4,4'-cyclohexylidenediphenol, 2,2-bis(4-hydroxyphenyl)-4-methylpentane, 2,4'-dihydroxydiphenylsulfone, 4,4'-dihydroxydiphenylsulfone, 3,3'-diallyl-4,4'-dihydroxydiphenylsulfone, 4-hydroxy-4'-methyldiphenylsulfone, 1,1-bis(4-hydroxyphenyl)-1-phenylethane, 1,4-bis[α-methyl-α-(4'-hydroxyphenyl)ethyl]benzene and like phenolic compounds; N-p-tolylsulfonyl-N'-phenylurea, 4,4'-bis[(4-methyl-3-phenoxycarbonylaminophenyl)ureido]diphenylmethane, N-p-tolylsulfonyl-N'-p-butoxyphenylurea and like compounds having sulfonyl group(s) and/or ureido group(s); zinc 4-[2-(p-methoxyphenoxy)ethyloxy]salicylate, zinc 4-[3-(p-tolylsulfonyl)propyloxy]salicylate, zinc 5-[p-(2-p-methoxyphenoxyethoxy)cumyl] salicylate and like aromatic carboxylic acid zinc salts; etc.

Examples of binders include polyvinyl alcohols of various molecular weights, modified polyvinyl alcohols, starch and derivatives thereof, methoxycellulose, carboxymethylcellulose, methylcellulose, ethylcellulose and like cellulose derivatives, sodium polyacrylate, polyvinyl pyrrolidone, acrylamide-acrylic ester copolymers, acrylamide-acrylic ester-methacrylic acid terpolymers, styrene-maleic anhydride copolymer alkali salts, polyacrylamides, sodium alginate, gelatin, casein and like water-soluble polymeric materials, polyvinyl acetates, polyurethanes, styrene-butadiene copolymers, polyacrylic acid, polyacrylic acid esters, vinyl chloride-vinyl acetate copolymers, polybutyl methacrylate, ethylene-vinyl acetate copolymers, styrene-butadiene-acrylic copolymers and like hydrophobic polymer latexes, etc.

The heat-sensitive recording layer may optionally comprise a sensitizer. Specific examples of sensitizers include stearic acid amide, stearic acid methylene bisamide, stearic acid ethylene bisamide, 4-benzylbiphenyl, p-tolylbiphenyl ether, di(p-methoxyphenoxyethyl)ether, 1,2-di(3-methylphenoxy)ethane, 1,2-di(4-methylphenoxy)ethane, 1,2-di(4-methoxyphenoxy)ethane, 1,2-di(4-chlorophenoxy)ethane, 1,2-diphenoxyethane, 1-(4-methoxyphenoxy)-2-(3-methylphenoxy)ethane, 2-naphthyl benzyl ether, 1-(2-naphthyloxy)-2-phenoxyethane, 1,3-di(naphthyloxy)propane, dibenzyl oxalate, di-p-methyl-benzyl oxalate, di-p-chlorobenzyl oxalate, dibutyl terephthalate, dibenzyl terephthalate, 2-(2'-hydroxy-5'-methylphenyl)benzotriazole, etc. Such sensitizers can be used singly or in combination.

The heat-sensitive recording layer may optionally comprise a pigment. Examples of pigments include inorganic fine particles made from calcium carbonate, silica, zinc oxide, titanium oxide, aluminium hydroxide, zinc hydroxide, barium sulfate, clay, calcined clay, talc, surface-treated calcium carbonate, silica, etc.; organic fine particles made from urea-formaldehyde resins, styrene-methacrylic acid copolymers, polystyrene resins, etc.

In addition to the above, various known auxiliaries such as lubricants, anti-foaming agents, wetting agents, preservatives, fluorescent brighteners, dispersing agents, thickeners, colorants, antistatic agents, cross-linking agents, etc. may be used.

In the heat-sensitive recording layer of the invention, the content of the leuco dye of a heat-sensitive coloring layer is typically from 5 to 20 mass %, and preferably from 6 to 19 mass %. The content of the developer is typically from 5 to 40 mass %, and preferably from 6 to 38 mass %. The content of the binder is typically from 5 to 20 mass %, and preferably from about 6 to about 20 mass %.

When a sensitizer is included, the content of the sensitizer in the heat-sensitive coloring layer is from 10 to 40 mass %, and preferably from 12 to 38 mass %. When a lubricant is used, the content of the lubricant in the heat-sensitive coloring layer is from 5 to 20 mass %, and preferably from 5 to 15 mass %. When a pigment is used, the content of the pigment in the heat-sensitive coloring layer is from 10 to 50 mass %, and preferably from 10 to 45 mass %.

Undercoat Layer

In accordance with the first and second embodiments of the invention, an undercoat layer may optionally be provided between the support and the heat-sensitive recording layer for further improving recording sensitivity and recording runnability.

The undercoat layer can be formed by applying over the support an undercoat layer coating composition that principally comprises a binder and at least one member selected from the group consisting of organic hollow particles, thermal expansion particles, and oil-absorbing pigments having an oil absorption of 70 mL/100 g or more, and preferably from about 80 to about 150 mL/100 g, and then drying the coating composition. The oil absorption is herein determined in accordance with JIS K 5101-1991.

While a variety of oil-absorbing pigments are usable, specific examples include inorganic pigments such as calcined kaolin, amorphous silica, light calcium carbonate, talc, etc. Such oil-absorbing pigments preferably have an average particle diameter of about 0.01 to about 5 μm, and more preferably about 0.02 to about 3 μm. The average particle diameter is a 50 percent value determined by a laser diffraction particle size distribution analyzer (trade name: "SALD 2000", manufactured by Shimadzu Seisakusho Co.).

The amount of oil-absorbing pigment used can be selected from a broad range, but is typically from about 2 to about 95 mass %, and preferably from about 5 to about 90 mass %, of total solids of the undercoat layer.

Known organic hollow particles are usable, and examples include particles having a void ratio of from about 50 to about 99%, whose shells are made of acrylic resin, styrene resin, vinylidene chloride resin, and the like. The void ratio is herein determined by $(d/D)\times 100$, where d represents the inside diameter of organic hollow particles, and D represents the outside diameter of the organic hollow particles. The organic hollow particles preferably have an average particle diameter of about 0.5 to about 10 μm, and more preferably about 1 to about 3 μm. The average particle diameter is a 50 percent value determined by a laser diffraction particle size distribution analyzer (trade name: "SALD 2000", manufactured by Shimadzu Seisakusho Co.).

The amount of organic hollow particles used can be selected from a broad range, but is typically from about 2 to about 90 mass % and preferably from about 5 to about 70 mass % of total solids of the undercoat layer.

When an oil-absorbing inorganic pigment is used together with organic hollow particles, the pigment and particles are each preferably used in the aforementioned range, and the total content of the pigment and particles is preferably from about 5 to about 90 mass % and more preferably from about 10 to about 80 mass % of total solids of the undercoat layer.

While a variety of thermal expansion particles are usable, specific examples include thermal expansion fine particles obtained by microencapsulation of low-boiling hydrocarbons with copolymers, such as vinylidene chloride, acrylonitrile, etc., by in-situ polymerization. Examples of low-boiling hydrocarbons include ethane, propane, etc.

The amount of thermal expansion particles used can be selected from a broad range, but is typically from about 1 to about 80 mass %, and preferably from about 10 to about 70 mass %, of total solids of the undercoat layer.

While the aforementioned binders for use in the heat-sensitive recording layer can be suitably used, preferable binders are starch-vinyl acetate graft copolymer, various polyvinyl alcohols, and styrene-butadiene copolymer latex.

Examples of polyvinyl alcohols include completely saponified polyvinyl alcohols, partially saponified polyvinyl alcohols, carboxy-modified polyvinyl alcohol, acetoacetyl-modified polyvinyl alcohol, diacetone-modified polyvinyl alcohol, silicon-modified polyvinyl alcohol, etc.

The amount of binder used can be selected from a broad range, but is typically from about 5 to about 30 mass %, and preferably from about 10 to about 25 mass %, of total solids of the undercoat layer.

In addition to the above, various known auxiliaries such as lubricants, anti-foaming agents, wetting agents, preservatives, fluorescent brighteners, dispersing agents, thickeners, colorants, antistatic agents, cross-linking agents, etc. can be used.

The undercoat layer may be applied in an amount of about 3 to about 20 g/m$^2$, and preferably about 5 to about 12 g/m$^2$, on a dry weight basis.

The undercoat layer can be applied by any known coating technique such as, for example, air-knife coating, vari-bar blade coating, pure blade coating, gravure coating, rod blade coating, short-dwell coating, curtain coating, die coating, etc.

Protective Layer According to the First Embodiment

The protective layer according to the first embodiment of the invention will be described below.

As previously explained, the heat-sensitive recording material according to the first embodiment comprises a support, a heat-sensitive recording layer comprising a leuco dye and a developer, and a protective layer principally comprising a pigment and a binder. The heat-sensitive recording layer and the protective layer are provided in this order over the support. The protective layer comprises a pigment of secondary particles with an average particle diameter of 30 to 900 nm formed by aggregation of amorphous silica primary particles with a particle diameter of 3 to 70 nm.

<Pigment>

The protective layer of the invention comprises the secondary particles with the aforementioned specific average particle diameter formed by aggregation of amorphous silica primary particles. This provides excellent printing-ink adhesion (i.e., ink fastness), and prevents the adhesion of ink to the thermal head by the protective layer absorbing the fused printing-ink component during recording with the thermal head, thereby reducing sticking. Another advantage thereto is improved recording sensitivity due to high transparency.

The above-defined secondary particles having an average particle diameter of 30-900 formed by aggregation of amorphous silica primary particles with a particle diameter of 3 to 70 nm for use in the invention may be produced by non-limiting suitable method. Examples of methods include a method of mechanically pulverizing commercially available synthetic amorphous silica or a like massive raw material, or mechanically pulverizing a precipitate formed by chemical reaction in the liquid phase or the like; the sol-gel process via the hydrolysis of metal alkoxide; high-temperature hydrolysis in the gas phase; and the like. Examples of mechanical means include the use of ultrasonic mill, high-speed rotation mill, roller mill, ball mill, media-agitating mill, jet mill, sand grinder, wet-type Media-less Ultra-atomization technology devices and the like. In the case of mechanical pulverization, pulverization is preferably performed in water to make an aqueous silica dispersion.

The amorphous silica primary particles for use in the invention have a particle diameter of 3 to 70 nm, preferably 5 to 50 nm, and more preferably 7 to 40 nm.

The primary particle diameter Dp can be determined according to the following equations:

$$Asp(m^2/g)=SA\times n \quad (1)$$

where Asp represents the specific surface area, SA represents the surface area of a single primary particle, and n represents the number of primary particles per 1 g; and $$Dp(nm)=3000(\times 10^{-9}\ g/m)/Asp \quad (2)$$

where Dp represents the primary particle diameter, and Asp represents the specific surface area.

Equation (2) is derived based on the assumption that the silica primary particles have a spherical shape, and the density of the silica is d=2(g/cm$^3$).

The specific surface area denotes the surface area of amorphous silica per unit mass (i.e., per 1 g). As can be seen from Equation (2), the smaller the value of the primary particle diameter is, the greater the value of the specific surface area is. The smaller the primary particle diameter is, the smaller the pores formed from the primary particles (i.e., pores formed in the secondary particles that are composed of agglomerates of the primary particle) are, thus resulting in higher capillary pressure. The fused ink component is believed to be absorbed rapidly for this reason, resulting in reduced sticking. It is also assumed that the arrangement of secondary particles formed from the primary particles becomes complex, thus ensuring a volume that can sufficiently absorb the fused ink component. The particle diameter of the primary particles is from 3 to 70 nm, preferably from 5 to 50 nm, and more preferably from 7 to 40 nm. The lower the upper limit for the particle diameter of the primary particles, the less the adhesion of residue to the thermal head becomes, and the better the anti-sticking properties becomes.

The specific surface area of amorphous silica was herein determined by drying a fine pigment (i.e., the amorphous silica used in the invention) at 105° C., and then measuring the nitrogen absorption-desorption isotherm of the resulting powder sample with a specific surface area measuring apparatus ("SA3100", manufactured by Coulter) after vacuum degassing at 200° C. for 2 hours, so as to calculate the BET specific surface area.

In this way, the particle diameter of the amorphous silica primary particles for use in the invention was determined by actual measurement of the specific surface area using the aforementioned specific surface area measuring apparatus ("SA3100" manufactured by Coulter), and then calculating the particle diameter in accordance with Equation (2).

The average particle diameter of the secondary particles is from 30 to 900 nm, preferably from 40 to 700 nm, and more preferably from 50 to 500 nm. Secondary particles with an average particle diameter of less than 30 nm are not only difficult to make, but also form pores whose volume is too small for the fused ink component to penetrate through, resulting in a risk of sticking. Conversely, secondary particles with an average particle diameter of more than 900 nm may result in lowered transparency, lowered recording sensitivity and/or lowered barrier properties.

The average particle diameter of the secondary particles was herein determined as follows. The aqueous silica dispersion obtained by the method described above was adjusted to a solids content of 5 mass %. The dispersion was then stirred and dispersed using a homomixer at 5,000 rpm for 30 minutes, and was immediately applied over a hydrophilicated polyester film in an amount of about 3 g/m$^2$ on a dry weight basis, and dried for use as a sample. The sample was observed with electron microscopes (SEM and TEM), and then electron micrographs of the sample were taken at a magnification of 10,000× to 400,000×. The Martin's diameters of the secondary particles in a 5-cm square of the electron micrographs were determined, and the average of the Martin's diameters was calculated (see "*Biryushi* handbook (Handbook for Fine Particles)", Asakura Publishing, 1991, p. 52).

The above-described process of stirring and dispersing the dispersion in a homomixer is performed in order just to uniformly disperse the particles for improving measurement accuracy, and this is not considered to practically cause the size of the secondary particles to change.

The content of the secondary particles in the protective layer is preferably from about 1 to about 40 mass % and more preferably from about 2.5 to about 30 mass % of total solids of the protective layer. Within the range of 1 to 40 mass %, the aforementioned desired effects such as excellent oil resistance and plasticizer resistance, in particular, can be readily attained.

Where necessary, other known pigments can also be added to the protective layer of the invention, so long as the desired effects of the invention are not impaired. Examples of such pigments include kaolin, light calcium carbonate, ground calcium carbonate, calcined kaolin, titanium oxide, magnesium carbonate, aluminium hydroxide, colloidal silica, synthetic layered mica, plastic pigment such as urea-formalin resin fillers and the like.

Note that colloidal silica is substantially composed of primary particles, and is substantially free from secondary particles that are agglomerates of the primary particles.

When any of these other pigments is used, the pigment is used in an amount of from about 0 to about 40 mass %, and preferably from about 0 to about 35 mass %, of total solids of the protective layer.

<Binder>

The protective layer comprises a binder in addition to the pigment described above. While a variety of binders used in protective layers of heat-sensitive recording materials are usable, an acrylic resin is especially preferable for use as the binder in the invention.

An acrylic resin that is used as a binder in the protective layer has good adhesion especially with ultraviolet curing ink, and is therefore preferably used. The acrylic resin may be a core-shell type two-layer emulsion or a single-layer emulsion.

Examples of monomer components usable for preparing the acrylic resin include acrylic acid, methacrylic acid, itaconic acid, maleic acid, fumaric acid, crotonic acid and like ethylenically unsaturated carboxylic acids; styrene, vinyltoluene, vinylbenzene, and like aromatic vinyl compounds; methyl acrylate, ethyl acrylate, hydroxyethyl acrylate, butyl acrylate, 2-ethylhexyl acrylate, octyl acrylate, and like alkyl esters of acrylic acid and methacrylic acid; acrylamide, methacrylamide, N-methylolacrylamide, N-methylolmethacrylamide and like derivatives of acrylamide and methacrylamide; diacetone acrylamide, glycidyl acrylate, glycidyl methacrylate, vinyl acetate, vinyl chloride, vinylidene chloride, butadiene, acrylonitrile, methacrylonitrile, dimethylaminoethyl methacrylate, trimethylaminoethyl methacrylate, diethylaminoethyl methacrylate, triethylaminoethyl methacrylate, etc.

Specific examples of monomer components usable for preparing the acrylic resin include the following:

(i) acrylic acid and methacrylic acid;

(ii) ethylenically unsaturated monocarboxylic acids such as crotonic acid and the like; ethylenically unsaturated dicarboxylic acids such as itaconic acid, maleic acid, fumaric acid and the like, and monoalkyl esters thereof such as $C_{1-10}$ monoalkyl esters, in particular;

(iii) methyl acrylate, ethyl acrylate, hydroxyethyl acrylate, butyl acrylate, 2-ethylhexyl acrylate, octyl acrylate, and like alkyl or hydroxyalkyl esters of acrylic acid and methacrylic acid ($C_{1-10}$ alkyl or $C_{1-10}$ hydroxyalkyl esters, in particular);

(iv) vinyl esters such as vinyl acetate, vinyl propionate and the like;

(v) aromatic vinyl compounds such as styrene, vinyltoluene, vinylbenzene and the like;

(vi) acrylamide compounds such as acrylamide, methacrylamide, N-methylolacrylamide, N-methylolmethacrylamide and the like;

(vii) heterocyclic vinyl compounds such as vinyl pyrrolidone and the like;

(viii) halogenated vinylidene compounds such as vinylidene chloride, vinylidene fluoride and the like;

(ix) α-olefins such as ethylene, propylene and the like;

(x) dienes such as butadiene and the like;

(xi) (meth)acrylonitrile; and so forth.

The term "(meth)acrylonitrile" as used herein denotes acrylonitrile, methacrylonitrile and a mixture thereof.

Examples of acrylic resins for use in the invention include copolymer resins of at least two monomers selected from the group consisting of monomers (i), (iii), (vi) and (xi); copolymer resins of at least one monomer selected from the group consisting of monomers (i), (iii), (vi) and (xi) with at least one monomer selected from the group consisting of monomers (ii), (iv), (v), (vii), (viii), (ix) and (x); etc. Examples of such copolymer resins include a copolymer resin of acrylic acid and acrylonitrile; a copolymer resin of acrylic acid, acrylonitrile and acrylamide; a copolymer resin of an acrylic acid $C_{1-10}$ alkyl ester and acrylonitrile; a quaternary copolymer resin of acrylic acid, acrylonitrile, acrylamide and an acrylic acid $C_{1-10}$ alkyl ester; etc.

Examples of preferred acrylic resins for use in the invention include copolymer resins of monomers (iii) and (xi) (e.g., a copolymer resin of an acrylic acid $C_{1-10}$ alkyl ester and acrylonitrile); and copolymer resins of monomers (i), (iii), (vi) and (xi) (e.g., a quaternary copolymer resin of acrylic acid, acrylonitrile, acrylamide and an acrylic acid $C_{1-10}$ alkyl ester).

Furthermore, in accordance with a particularly preferred embodiment of the invention, the acrylic resins for use as a binder are preferably copolymers of (meth)acrylonitrile and a vinyl monomer copolymerizable with (meth)acrylonitrile, and among such copolymers preferably has a glass transition tempretature (Tg) of −10 to 100° C., and more preferably 0 to 80° C. are preferred.

The proportion of (meth)acrylonitrile in the copolymer is not limited so long as the effects of the invention can be attained, but is preferably from about 20 to about 80 mass %, and more preferably from about 30 to about 70 mass %.

Examples of vinyl monomers copolymerizable with (meth)acrylonitrile include the monomers (i) to (x) mentioned above. In the copolymer for use in the invention, the proportion of vinyl monomer copolymerizable with (meth) acrylonitrile is not limited so long as the effects of the invention can be attained, but is preferably from about 80 to about 20 mass %, and more preferably from about 70 to about 30 mass %.

The vinyl monomer preferably comprises, among vinyl monomers copolymerizable with (meth)acrylonitrile, at least one vinyl monomer containing one or more (preferably one or two) carboxyl groups.

The proportion of the carboxyl group-containing vinyl monomer per total mass of the copolymer resin is preferably from 1 to 10 mass %, and more preferably from 2 to 8 mass %.

Examples of carboxyl group-containing vinyl monomers include at least one or a combination of monomers selected from group (i) (namely, at least one of acrylic acid and methacrylic acid), group (ii) (namely, ethylenically unsaturated monocarboxylic acids such as crotonic acid and the like; and ethylenically unsaturated dicarboxylic acids such as itaconic acid, maleic acid, fumaric acid, and the like), and monoalkyl esters ($C_{1-10}$ monoalkyl esters, in particular) of groups (i) and (ii).

Preferable examples among the carboxyl group-containing vinyl monomers mentioned above are one or a combination of monomers selected from the group consisting of ethylenically unsaturated monocarboxylic acids such as acrylic acid, methacrylic acid; crotonic acid, and the like; ethylenically unsaturated dicarboxylic acids such as itaconic acid, maleic acid, fumaric acid and the like; and monoalkyl esters thereof ($C_{1-10}$ monoalkyl esters, in particular).

Preferable copolymers among those mentioned above are copolymers of at least one monomer selected from acrylonitrile and methacrylonitrile in group (xi) and at least one monomer selected from alkyl or hydroxyalkyl esters ($C_{1-10}$ alkyl or $C_{1-10}$ hydroxyalkyl esters, in particular) of acrylic acid and methacrylic acid in group (iii). Such copolymers preferably have a glass transition temperature Tg of about −10 to about 100° C., and more preferably about 0 to about 80° C. The contents of monomer (xi) and monomer (iii) in the copolymer can be suitably selected from a broad range; but, typically, the content of monomer (xi) is preferably from about 20 to about 80 mass % (more preferably from about 30 to about 70 mass %), and the content of monomer (iii) is preferably from about 80 to about 20 mass % (more preferably from about 70 to about 30 mass %).

Also preferable are copolymers of monomers from the following groups (xi), (iii), (i) and (vi) below:

(xi) at least one member selected from the group consisting of acrylonitrile and methacrylonitrile;

(iii) at least one member selected from the group consisting of alkyl or hydroxyalkyl esters (especially $C_{1-10}$ alkyl or $C_{1-10}$ hydroxyalkyl esters) of acrylic acid and methacrylic acid;

(i) at least one member selected from the group consisting of acrylic acid and methacrylic acid; and (vi) at least one member selected from the group consisting of acrylamide, methacrylamide, N-methylolacrylamide, N-methylolmethacrylamide and like acrylamide compounds.

Among such copolymers of monomers (xi), (iii), (i) and (vi), those having a glass transition temperature Tg of about 30 to about 100° C., and more preferably about 30 to about 70° C., are preferred.

The contents of these monomers in the copolymer can be suitably selected from a broad range; but, for example, the content of monomer (i) is preferably from 1 to 10 mass % (more preferably from about 2 to about 8 mass %), the content of monomer (iii) is preferably from 1 to 50 mass % (more preferably from about 2 to about 45 mass %), the content of monomer (vi) is preferably from 1 to 50 mass % (more preferably from about 2 to about 45 mass %), and the content of monomer (xi) is preferably from 20 to 80 mass % (more preferably from about 30 to about 70 mass %).

While the amount of acrylic resin used can be suitably selected from a broad range, it is preferably from 10 to 70 mass % of total solids of the protective layer. Within this range, the resulting heat-sensitive recording material exhibits excellent adhesion especially with ultraviolet curing ink, reduced adhesion of residue to the thermal head, and a reduced possibility of sticking of the printed portion during recording. The proportion of acrylic resin to total solids of the protective layer is more preferably from about 15 to about 60 mass %.

Because acrylic resins may have poor barrier properties against plasticizers and solvents such as oils, the acrylic resin is preferably used together with a water-soluble resin. Examples of water-soluble resins include polyvinyl alcohols, modified polyvinyl alcohols, polyvinyl acetals, polyethyleneimine, polyvinyl pyrrolidone, polyacrylamide, starch and derivatives thereof, cellulose and derivatives thereof, gelatin, casein, etc.

Among such water-soluble resins, polyvinyl alcohols and modified polyvinyl alcohols are preferable because they exhibit superior binding effects with pigments and the recorded portions excellent durability against plasticizers and solvents such as oils. Particularly preferred are modified polyvinyl alcohols such as acetoacetyl-modified polyvinyl alcohol, carboxy-modified polyvinyl alcohol, diacetone-modified polyvinyl alcohol and the like.

Among such modified polyvinyl alcohols, typically, acetoacetyl-modified polyvinyl alcohol having a polymerization degree of about 500 to about 1800, and preferably about 700 to about 1800, and diacetone modified-polyvinyl alcohol having a polymerization degree of about 500 to about 3000, and preferably about 700 to about 3000, are preferably used.

When such a water-soluble resin, in particular, a polyvinyl alcohol or a modified polyvinyl alcohol is used, the proportion of water-soluble resin to total solids of the above-described acrylic resin is from about 25 to about 600 mass %, preferably from about 25 to about 550 mass %, and more preferably from about 30 to about 500 mass %. Within the range of about 25 to about 600 mass %, a good binder effect, good durability of recorded portions against solvents, and good ink adhesion can be obtained.

In addition to the above, various known auxiliaries may suitably be added to the protective layer, such as lubricants, anti-foaming agents, wetting agents, preservatives, fluorescent brighteners, dispersing agents, thickeners, colorants, antistatic agents, cross-linking agents and the like.

Heat-Sensitive Recording Material According to the First Embodiment

The heat-sensitive recording material according to the first embodiment of the invention can be prepared using a commonly known method. For example, the above-described leuco dye and developer are separately pulverized and dispersed together with an aqueous binder solution using a disperser such as a ball mill, and then mixed and stirred optionally with a sensitizer, a pigment and a variety of auxiliaries, so as to prepare a heat-sensitive recording layer coating composition. A protective layer coating composition is also prepared by mixing the above-described silica dispersion, acrylic resin, other(s) binder and a variety of auxiliaries, and stirring the mixture. The heat-sensitive recording layer coating composition and the protective layer coating composition are then applied and dried in this order over the support by a known method.

The amount of heat-sensitive recording layer coating composition applied on a dry weight basis can be suitably selected from a broad range, but is typically from about 1.5 to about 10 $g/m^2$, and more preferably from about 2 to about 8 $g/m^2$.

The amount of protective layer coating composition applied on a dry weight basis can also suitably be selected from a broad range, but is typically from 0.2 to about 5 $g/m^2$, and preferably from about 0.3 to about 3.5 $g/m^2$.

As previously described, the heat-sensitive recording material according to the first embodiment is especially suitable for use as paper for tickets or the like when printed, and it has excellent ink fixation properties and reduces sticking of the printed portion to such an extent that substantially or practically no problems arise during recording.

Therefore, the heat-sensitive recording material according to the first embodiment advantageously has on the protective layer thereof a printed portion formed by printing. Ultraviolet curing ink is preferably used as a printing ink, and printing may be performed by a conventional method.

A variety of known ultraviolet curing inks are available, which typically comprise coloring materials, prepolymers, monomers, photoinitiators and additives. Examples of coloring materials include organic coloring pigments, inorganic coloring pigments, dyes, fluorescent dyes, etc.

Examples of prepolymers include polyol acrylates, epoxy acrylates, urethane acrylates, polyester acrylates, alkyd acrylates, polyether acrylates, etc.

Examples of monomers include monoacrylates, diacrylates, triacrylates, etc.

The photoinitiator for use in the invention may suitably be selected from known photoinitiators depending on the prepolymers and monomers used.

Examples of additives include lubricants, anti-foaming agents, surfactants, etc.

Various types of ultraviolet curing inks containing such components are commercially available from the market. Examples of such inks include the Flash Dry series (manufactured by Toyo Ink Corporation) such as FDS TK series, FDS new series, etc.; BEST CURE series (manufactured by T&K TOKA Company) such as "UV RNC", "UV NVR", "UV STP", etc.; DAI Cure series (manufactured by Dainippon Ink and Chemicals) such as "ABILIO", "SCEPTER", "MUseal" etc.

Protective Layer According to the Second Embodiment

The heat-sensitive recording material according to the second embodiment will be next described.

The heat-sensitive recording material according to the second embodiment comprises a support, a heat-sensitive recording layer comprising a leuco dye and a developer, and a protective layer principally comprising a pigment and a binder. The heat-sensitive recording layer and the protective layer are provided in this order over the support. The protective layer comprises, as the pigment, secondary particles with an average particle diameter of 30 to 900 nm formed by aggregation of amorphous silica primary particles with a particle diameter of 3 to 70 nm, and as the binder, acetoacetyl-modified polyvinyl alcohol with a saponification degree of 90 to 100 mol % and a polymerization degree of 1900 to 5000.

The heat-sensitive recording material according to the second embodiment is especially suitable for use in medical institutions, libraries, etc, and exhibits reduction in sticking to such an extent that substantially or practically no problems arise, reduced adhesion of residue to the thermal head, high recording sensitivity, and barrier properties against chemicals such as alcohols and the like that are even higher than those of the heat-sensitive recording material according to the first embodiment.

<Pigment>

The secondary particles with an average particle diameter of 30 to 900 nm formed by aggregation of amorphous silica primary particles are used in the protective layer according to the second embodiment. This prevents sticking by absorbing the protective layer component fused or softened by heat produced from the thermal head without deteriorating the barrier properties. Another advantage thereof is improved recording sensitivity due to high transparency.

The secondary particles described in the aforementioned first embodiment are usable as the secondary particles formed by aggregation of amorphous silica primary particles for use in the second embodiment.

Hence, the particle diameter of the amorphous silica primary particles for use in the invention is from 3 to 70 nm, preferably from 5 to 50 nm, and more preferably from 7 to 40 nm.

The particle diameter of the amorphous silica primary particles for use in the invention was determined by actual measurement of the specific surface area using the same specific surface area measuring apparatus ("SA 3100" manufactured by Coulter) as mentioned above, and calculating in accordance with Equation (2).

The specific surface area of amorphous silica was herein determined by drying a fine pigment (i.e., the amorphous silica used in the invention) at 105° C., and then measuring the nitrogen absorption-desorption isotherm of the resulting powder sample with a specific surface area measuring apparatus ("SA3100", manufactured by Coulter) after vacuum degassing at 200° C. for 2 hours, so as to calculate the BET specific surface area.

The average particle diameter of the secondary particles is from 30 to 900 nm, preferably from 40 to 700 nm, and more preferably from 50 to 500 nm. Secondary particles with an average particle diameter of less than 30 nm are not only difficult to make, but also form pores with a volume too small for the fused or softened protective layer component to penetrate through, resulting in a risk of sticking. Conversely, secondary particles with an average particle diameter of more than 900 nm may, due to excessively large particle diameter, result in lowered barrier properties, and reduced transparency, and lowered recording sensitivity.

Note that the average particle diameter of the secondary particles is measured by the same method as described in the aforementioned first embodiment.

The content of the above-specified amorphous silica secondary particles in the protective layer is preferably from about 10 to about 40 mass %, and more preferably from about 12.5 to about 37.5 mass %, of total solids of the protective layer. Within the range of 10 to 40 mass %, the desired effects can be easily attained, along with good barrier properties.

Where necessary, known pigment(s) can also be added to the protective layer, so long as the desired effects of the invention are not impaired. Examples of such pigments include kaolin, light calcium carbonate, ground calcium carbonate, calcined kaolin, titanium oxide, magnesium carbonate, aluminium hydroxide, colloidal silica, urea-formalin resin fillers, plastic pigments, etc.

When any of these pigments is used, the amount thereof is from about 0 to about 40 mass %, and preferably from about 0 to about 35 mass %, of total solids of the protective layer.

<Binder>

In the second embodiment, it is important to use, as the binder, acetoacetyl-modified polyvinyl alcohol with a saponification degree of 90 to 100 mol % and a polymerization degree of 1900 to 5000, preferably 1900 to 4500, and more preferably 1900 to 4000. This provides barrier properties even better than those obtained in the first embodiment. If the saponification degree is less than 90 mol %, unsaponified groups will cause steric hindrance during film formation, resulting in lowered film formation and barrier properties. Moreover, if the polymerization degree is less than 1900, film formation will deteriorate. If, however, the polymerization degree exceeds 5000, the solubility in water will deteriorate, so that when a certain amount of such acetoacetyl-modified polyvinyl alcohol is added, the concentration of the protective layer coating composition may remarkably decrease, with the result that the coating composition may not be applied in the desired amount or coating may become impossible.

The amount of acetoacetyl-modified polyvinyl alcohol used can be suitably selected from a broad range; but typically, it is preferably from 30 to 80 mass % and more preferably from 32 to 75 mass %, of total solids of the protective layer. Within the range of 30 to 80 mass %, good barrier properties and a satisfactory sticking-reducing effect can be obtained.

Addition of acrylic resin to the protective layer is preferable, because this provides good ink fixation properties when the protective layer is printed with ultraviolet curable ink.

Any of the acrylic resins mentioned in the aforementioned first embodiment are usable as the acrylic resin. Preferable among those are copolymers of (xi) at least one monomer selected from the group consisting of acrylonitrile and methacrylonitrile; and (iii) at least one monomer selected from the group consisting of alkyl or hydroxyalkyl esters (especially $C_{1-10}$ alkyl or $C_{1-10}$ hydroxyalkyl esters) of acrylic acid and methacrylic acid. Among such copolymers, those having a glass transition temperature Tg of about −10 to about 100° C., and more preferably about 0 to about 80° C., are preferred.

The contents of monomer (xi) and monomer (iii) in the copolymer can be suitably selected from a broad range; but, typically, the content of monomer (xi) is preferably from about 20 to about 80 mass % (more preferably from about 30 to about 70 mass %), and the content of monomer (iii) is preferably from about 80 to about 20 mass % (more preferably from about 70 to about 30 mass %).

Preferable acrylic resins are copolymers of (xi) at least one monomer selected from the group consisting of acrylonitrile and methacrylonitrile; (iii) at least one monomer selected from the group consisting of alkyl or hydroxyalkyl esters (especially $C_{1-10}$ alkyl or $C_{1-10}$ hydroxyalkyl esters) of acrylic acid and methacrylic acid; (i) at least one monomer selected from the group consisting of acrylic acid and methacrylic acid; and (vi) at least one monomer selected from the group consisting of acrylamide, methacrylamide, N-methylolacrylamide, N-methylolmethcrylamide and like acrylamide compounds. Among such copolymers, preferable are those having a glass temperature Tg of about 30 to about 100° C., and more preferably about 30 to about 70° C.

The proportions of these monomers in the copolymer can be suitably selected from a broad range; but, for example, the copolymer preferably comprises monomer (i) in a proportion of 1 to 10 mass % (more preferably from about 2 to about 8 mass %), monomer (iii) in a proportion of 1 to 50 mass % (more preferably from about 2 to about 45 mass %), monomer (vi) in a proportion of 1 to 50 mass % (more preferably from about 2 to about 45 mass %), and monomer (xi) in a proportion of 20 to 80 mass % (more preferably from about 30 to about 70 mass %).

When an acrylic resin is used, the amount thereof is preferably from 5 to 40 mass % of total solids of the protective layer. Within this range, good adhesion especially with ultraviolet curing ink, good barrier properties, and a low possibility of sticking can be attained. The proportion of the acrylic resin to total solids of the protective layer is more preferably from about 10 to about 35 mass %.

Moreover, zinc stearate is preferably used in the protective layer as a lubricant, because the addition of a small amount of zinc stearate reduces sticking without lowering the barrier properties. Zinc stearate, if used, is preferably contained in a proportion of 2 to 7.5 mass % of total solids of the protective layer. Within this range, both the barrier properties and the ability to prevent sticking can further be improved. Needless to say, other lubricant(s) may be used together with zinc stearate, so long as the desired effects are not lost.

The protective layer may further comprise, as necessary, a variety of known auxiliaries such as anti-foaming agents, wetting agents, preservatives, fluorescent brighteners, dispersing agents, thickeners, colorants, antistatic agents, etc., as appropriate.

Heat-Sensitive Recording Material According to the Second Embodiment

The heat-sensitive recording material according to the second embodiment can be prepared by a commonly known method. For example, the above-described leuco dye and developer are separately pulverized and dispersed together with an aqueous binder solution using a disperser such as a ball mill, and then mixed and stirred optionally with a sensitizer, a pigment and a variety of auxiliaries, so as to prepare a heat-sensitive recording layer coating composition. A protective layer coating composition is also prepared by mixing the silica dispersion, acrylic resin, other binder(s) and a variety of auxiliaries, and stirring the mixture. The heat-sensitive recording layer coating composition and the protective layer coating composition are then applied and dried in this order over the support by a known method.

The amount of heat-sensitive recording layer coating composition applied on a dry weight basis can be suitably selected from a broad range; but typically, it is preferably from about 1.5 to about 10 g/m$^2$, and more preferably from about 2 to about 8 g/m$^2$.

The protective layer according to the second embodiment, even when applied in a small amount, exhibits reduced adhesion of residue to the thermal head, reduced sticking, and high barrier properties against alcohols and the like, thus resulting in high recording sensitivity. The protective layer is preferably applied in an amount of 0.3 to 2.5 g/m$^2$, and more preferably in an amount of 0.4 to 2.2 g/m$^2$, on a dry weight basis. Within the range of 0.3 to 2.5 g/m$^2$, reduced sticking and good barrier properties, as well as good recording sensitivity can be attained.

In both the first and second embodiments of the invention, various techniques known in the field of heat-sensitive recording material preparation can be additionally applied as required. Examples of such techniques include the application of smoothing treatments such as supercalendering after the formation of each or all of the layers; forming on the rear surface of the support of the heat-sensitive recording material a protective layer, a coating layer for printing, a magnetic recording layer, an antistatic layer, a thermal transfer recording layer, an ink jet recording layer and/or the like, as necessary; processing the heat-sensitive recording material into an adhesive label by adhesive-processing the rear surface of the support; perforating the heat-sensitive recording material; and so forth. Moreover, the heat-sensitive recording layer of the heat-sensitive recording material can be imparted with a multicolor-recording capability.

EXAMPLES

The present invention will be described in more detail below by way of Examples, which are not intended to limit the invention. In the following Examples and Comparative Examples, "parts" and "%" represent "parts by mass" and "% by mass", respectively, unless otherwise specified.

The silica dispersions used in the Examples and Comparative Examples were prepared as follows.

Note that the "average secondary particle diameter" of commercially available silica used for the preparation of each of Silica Dispersions A to J is the value shown in the manufacturer's catalog, unless otherwise specified.

The "primary particle diameters" of the commercially available silica and the silica dispersion obtained after pulverization and dispersion in each of Silica Dispersions A to J were determined in accordance with Equation (2) shown above, using the value of the specific surface area. The "average particle diameter of secondary particles" of the silica dispersion obtained after pulverization and dispersion was determined by the procedure described in the section "average particle diameter of secondary particles" described below.

<Preparation of Silica Dispersion A>

Commercially available silica (trade name: Reolosil QS-30, manufactured by Tokuyama Co., Ltd.; average secondary particle diameter as determined by a laser light-scattering technique: 1500 nm; primary particle diameter: 10 nm; specific surface area: 300 m$^2$/g) was dispersed in water and pulverized using a sand grinder. Pulverization and dispersion was then repeated using a wet-type Media-less Ultra-atomization technology device (trade name: Nanomizer, manufactured by Yoshida Kikai, Co., Ltd.) to form 10% Silica Dispersion A having a primary particle diameter of 10 nm and an average particle diameter of secondary particles of 80 nm.

<Preparation of Silica Dispersion B>

Commercially available silica (trade name: Finesil X-45, manufactured by Tokuyama Co., Ltd.; average secondary particle diameter: 4500 nm; primary particle diameter: 12 nm; specific surface area: 260 m$^2$/g) was dispersed in water and pulverized using a sand grinder. Pulverization and dispersion was then repeated using a wet-type Media-less Ultra-atomization technology device (trade name: Nanomizer, manufactured by Yoshida Kikai, Co., Ltd.) to form 10% Silica Dispersion B having a primary particle diameter of 12 nm and an average particle diameter of secondary particles of 300 nm.

<Preparation of Silica Dispersion C>

Commercially available silica (trade name: Finesil X-45, manufactured by Tokuyama Co., Ltd.; average secondary particle diameter: 4500 nm; primary particle diameter: 12 nm; specific surface area: 260 m$^2$/g) was dispersed in water and pulverized using a sand grinder. Pulverization and dispersion was then repeated using a wet-type Media-less Ultra-atomization technology device (trade name: Nanomizer, manufactured by Yoshida Kikai, Co., Ltd.) to form 10% Silica Dispersion C having a primary particle diameter of 12 nm and an average particle diameter of secondary particles of 500 nm.

<Preparation of Silica Dispersion D>

Commercially available silica (trade name: Finesil X-45, manufactured by Tokuyama Co., Ltd.; average secondary particle diameter: 4500 nm; primary particle diameter: 12 nm; specific surface area: 260 m$^2$/g) was dispersed in water and pulverized using a sand grinder. Pulverization and dispersion was then repeated using a wet-type Media-less Ultra-atomization technology device (trade name: Nanomizer, manufactured by Yoshida Kikai, Co., Ltd.) to form 10% Silica Dispersion D having a primary particle diameter of 12 nm and an average particle diameter of secondary particles of 700 nm.

<Preparation of Silica Dispersion E>

Commercially available silica (trade name: Finesil X-45, manufactured by Tokuyama Co., Ltd.; average secondary particle diameter: 4500 nm; primary particle diameter: 12 nm; specific surface area: 260 m$^2$/g) was dispersed in water and pulverized using a sand grinder. Pulverization and dispersion was then repeated using a wet-type Media-less Ultra-atomization technology device (trade name: Nanomizer, manufactured by Yoshida Kikai, Co., Ltd.) to form 10% Silica Dispersion E having a primary particle diameter of 12 nm and an average particle diameter of secondary particles of 900 nm.

<Preparation of Silica Dispersion F>

Commercially available silica (trade name: Mizukasil P-527, manufactured by Mizusawa Industrial Chemicals, Ltd.; average secondary particle diameter: 4500 nm; primary particle diameter: 54 nm; specific surface area: 56 m$^2$/g) was dispersed in water and pulverized using a sand grinder. Pulverization and dispersion was then repeated using a wet-type Media-less Ultra-atomization technology device (trade name: Nanomizer, manufactured by Yoshida Kikai, Co., Ltd.) to form 10% Silica Dispersion F having a primary particle diameter of 54 nm and an average particle diameter of secondary particles of 900 nm.

<Preparation of Silica Dispersion G>

Commercially available silica (trade name: Finesil X-45, manufactured by Tokuyama Co., Ltd.; average secondary particle diameter: 4500 nm; primary particle diameter: 12 nm; specific surface area: 260 m$^2$/g) was dispersed in water using an agitator to form 10% Silica Dispersion G having a primary particle diameter of 12 nm and an average particle diameter of secondary particles of 4500 nm.

<Preparation of Silica Dispersion H>

Commercially available silica (trade name: Finesil X-45, manufactured by Tokuyama Co., Ltd.; average secondary particle diameter: 4500 nm; primary particle diameter: 12 nm; specific surface area: 260 $m^2/g$) was dispersed in water and pulverized using a sand grinder. Pulverization and dispersion was then repeated using a wet-type Media-less Ultra-atomization technology device (trade name: Nanomizer, manufactured by Yoshida Kikai, Co., Ltd.) to form 10% Silica Dispersion H having a primary particle diameter of 12 nm and an average particle diameter of secondary particles of 1000 nm.

<Preparation of Silica Dispersion I>

Commercially available silica (trade name: Mizukasil P-527, manufactured by Mizusawa Industrial Chemicals, Ltd.; average secondary particle diameter: 4500 nm; primary particle diameter: 54 nm; specific surface area: 56 $m^2/g$) was dispersed in water and pulverized using a sand grinder. Pulverization and dispersion was then repeated using a wet-type Media-less Ultra-atomization technology device (trade name: Nanomizer, manufactured by Yoshida Kikai, Co., Ltd.) to form 10% Silica Dispersion I having a primary particle diameter of 54 nm and an average particle diameter of secondary particles of 1000 nm.

<Preparation of Silica Dispersion J>

Commercially available silica (trade name: Mizukasil P-527, manufactured by Mizusawa Industrial Chemicals, Ltd.; average secondary particle diameter: 4500 nm; primary particle diameter: 54 nm; specific surface area: 56 $m^2/g$) was dispersed in water and pulverized using a sand grinder. Pulverization and dispersion was then repeated using a wet-type Media-less Ultra-atomization technology device (trade name: Nanomizer, manufactured by Yoshida Kikai, Co., Ltd.) to form 10% Silica Dispersion J having a primary particle diameter of 54 nm and an average particle diameter of secondary particles of 1200 nm.

The average particle diameter of the silica secondary particles used in each of the Examples and Comparative Examples was determined by the following procedure.

<Average Particle Diameter of Secondary Particles>

Each silica dispersion obtained as described above was diluted with water to a concentration of 5 mass %. The diluted silica dispersion was stirred and dispersed using a homomixer at 5,000 rpm for 30 minutes. The resulting dispersion was then immediately applied to a hydrophilicated polyester film in an amount of about 3 $g/m^2$ on a dry weight basis and dried for use as a sample. The sample was observed with electron microscopes (SEM and TEM), and electron micrographs of the sample were taken at a magnification of 10,000× to 400,000×. The Martin's diameters of the secondary particles in a 5-cm square were determined and the average of the Martin's diameters was calculated (see "Biryushi handbook (Handbook for Fine Particles)", Asakura Publishing, 1991, p. 52).

Example I-1

<Preparation of Undercoat Layer Coating Composition>

A dispersion of 85 parts of calcined clay (trade name: Ansilex, manufactured by Engelhard Corporation) in 320 parts of water was mixed with 40 parts of a styrene-butadiene copolymer emulsion (solids content: 50%) and 50 parts of a 10% aqueous solution of oxidized starch, and the mixture was then stirred to give an undercoat layer coating composition.

<Preparation of Leuco Dye Dispersion (Dispersion (a))>

A composition comprising 10 parts of 3-(N-ethyl-N-isopentylamino)-6-methyl-7-anilinofluoran, 5 parts of a 5% aqueous solution of methylcellulose, and 15 parts of water was pulverized using a sand mill to an average particle diameter of 1.5 μn, thus giving a leuco dye dispersion (Dispersion (a)).

<Preparation of Developer Dispersion (Dispersion (b))>

A composition comprising 10 parts of 3,3'-diallyl-4,4'-dihydroxydiphenylsulfone, 5 parts of a 5% aqueous solution of methylcellulose, and 15 parts of water was pulverized using a sand mill to an average particle diameter of 1.5 μm, thus giving a developer dispersion (Dispersion (b)).

<Preparation of Sensitizer Dispersion (Dispersion (c))>

A composition comprising 20 parts of 1,2-di(3-methylphenoxy)ethane, 5 parts of a 5% aqueous solution of methylcellulose, and 55 parts of water was pulverized using a sand mill to an average particle diameter of 1.5 μm, thus giving a sensitizer dispersion (Dispersion (c)).

<Preparation of Heat-sensitive Recording Layer Coating Composition>

A composition comprising 25 parts of Dispersion (a), 50 parts of Dispersion (b), 50 parts of Dispersion (c), 30 parts of a 20% aqueous solution of oxidized starch, 10 parts of light calcium carbonate, 50 parts of a 10% aqueous solution of polyvinyl alcohol, and 10 parts of water was mixed and stirred to give a heat-sensitive recording layer coating composition.

<Preparation of Protective Layer Coating Composition>

A composition comprising 100 parts of a 10% aqueous solution of acetoacetyl-modified polyvinyl alcohol (trade name: Gohsefimer Z-200, manufactured by Nippon Synthetic Chemical Industry Co., Ltd.; polymerization degree: 1000), 20 parts of an acrylic resin (trade name: Polysol AM 2250, manufactured by Showa Highpolymer Co., Ltd.; copolymer of alkyl acrylate ester and acrylonitrile; Tg: 10° C.; solids concentration: 50%), 20 parts of Silica Dispersion A, 2 parts of a 30% dispersion of zinc stearate, and 20 parts of water was mixed and stirred to give a protective layer coating composition.

<Preparation of Heat-sensitive Recording Material>

The undercoat layer coating composition was applied to one side of a 48 $g/m^2$ base paper in an amount of 9.0 $g/m^2$ on a dry weight basis and dried. The heat-sensitive recording layer coating composition was then applied to the undercoat layer in an amount of 5.0 $g/m^2$ on a dry weight basis and dried. The protective layer coating composition was further applied to the heat-sensitive recording layer in an amount of 2 $g/m^2$ on a dry weight and dried. The paper thus coated was subsequently supercalendered to yield a heat-sensitive recording material having a smoothness of 1,000 to 4,000 seconds as measured by an Oken-type smoothness tester.

Example I-2

A heat-sensitive recording material was prepared in the same manner as in Example I-1, except that 20 parts of Silica Dispersion B were used instead of 20 parts of Silica Dispersion A.

Example I-3

A heat-sensitive recording material was prepared in the same manner as in Example I-1, except that 20 parts of Silica Dispersion C were used instead of 20 parts of Silica Dispersion A.

Example I-4

A heat-sensitive recording material was prepared in the same manner as in Example I-1, except that 20 parts of Silica Dispersion D were used instead of 20 parts of Silica Dispersion A.

Example I-5

A heat-sensitive recording material was prepared in the same manner as in Example I-1, except that 20 parts of Silica Dispersion F were used instead of 20 parts of Silica Dispersion A.

Example I-6

A heat-sensitive recording material was prepared in the same manner as in Example I-2, except that 40 parts of an acrylic resin (trade name: Bariastar-OT-1035-1, manufactured by Mitsui Chemicals inc.; copolymer of (meth)acrylonitrile, alkyl (meth)acrylate, 2-hydroxyethyl (meth)acrylate, (meth)acrylic acid, and (meth)acrylamide; the mass proportion of (meth)acrylic acid to the total copolymer resin is 5%; Tg: 50° C.; solids concentration: 25%) were used instead of 20 parts of the acrylic resin (trade name: Polysol AM 2250, manufactured by Showa Highpolymer Co., Ltd.; solids concentration: 50%) used in Example I-2.

Example I-7

A heat-sensitive recording material was prepared in the same manner as in Example I-2, except that 100 parts of a 10% aqueous solution of diacetone-modified polyvinyl alcohol (trade name: DF-24, manufactured by Japan Vam & Poval Co., Ltd.; polymerization degree: 2400) were used instead of 100 parts of the 10% aqueous solution of acetoacetyl-modified polyvinyl alcohol (trade name: "Gohsefimer Z-200", manufactured by Nippon Synthetic Chemical Industry Co., Ltd.; polymerization degree: 1000) used in Example I-2.

Example I-8

A heat-sensitive recording material was prepared in the same manner as in Example I-2, except that 4 parts of Silica Dispersion B were used instead of 20 parts of Silica Dispersion B.

Example I-9

A heat-sensitive recording material was prepared in the same manner as in Example I-2, except that 80 parts of Silica Dispersion B were used instead of 20 parts of Silica Dispersion B.

Example I-10

A heat-sensitive recording material was prepared in the same manner as in Example I-2, except that 40 parts of a 10% aqueous solution of acetoacetyl-modified polyvinyl alcohol (trade name: Gohsefimer Z-200, manufactured by Nippon Synthetic Chemical Industry Co., Ltd.; polymerization degree: 1000) and 30 parts of an acrylic resin (trade name: Polysol AM 2250, manufactured by Showa Highpolymer Co., Ltd.; solids concentration: 50%) were used instead of 100 parts of the 10% aqueous solution of acetoacetyl-modified polyvinyl alcohol (trade name: Gohsefimer Z-200, manufactured by Nippon Synthetic Chemical Industry Co., Ltd.; polymerization degree: 1000) and 20 parts of the acrylic resin (trade name: Polysol AM 2250, manufactured by Showa Highpolymer Co., Ltd.; solids concentration: 50%) used in Example I-2.

Example I-11

A heat-sensitive recording material was prepared in the same manner as in Example I-2, except that 160 parts of a 10% aqueous solution of acetoacetyl-modified polyvinyl alcohol (trade name: Gohsefimer Z-200, manufactured by Nippon Synthetic Chemical Industry Co., Ltd.; polymerization degree: 1000) and 6 parts of an acrylic resin (trade name: Polysol AM 2250, manufactured by Showa Highpolymer Co., Ltd.; solids concentration: 50%) were used instead of 100 parts of the 10% aqueous solution of acetoacetyl-modified polyvinyl alcohol (trade name: Gohsefimer Z-200, manufactured by Nippon Synthetic Chemical Industry Co., Ltd.; polymerization degree: 1000) and 20 parts of the acrylic resin (trade name: Polysol AM 2250, manufactured by Showa Highpolymer Co., Ltd.; solids concentration: 50%) used in Example I-2.

Example I-12

A heat-sensitive recording material was prepared in the same manner as in Example I-2, except that 20 parts of a 50% dispersion of aluminum hydroxide (trade name: Higilite H-42, manufactured by Showa Denko K.K.) were further added to the protective layer coating composition used in Example I-2.

Example I-13

A heat-sensitive recording material was prepared in the same manner as in Example I-2, except that 25 parts of a 40% dispersion of kaoline (trade name: UW 90, manufactured by Engelhard Corporation) were further added to the protective layer coating composition used in Example I-2.

Comparative Example I-1

A heat-sensitive recording material was prepared in the same manner as in Example I-1, except that 4 parts of a 50% dispersion of aluminum hydroxide (trade name: Higilite H-42, manufactured by Showa Denko K.K.) were used instead of 20 parts of Silica Dispersion A used in Example I-1.

Comparative Example I-2

A heat-sensitive recording material was prepared in the same manner as in Example I-1, except that 10 parts of a colloidal silica (trade name: Snowtex 20, manufactured by Nissan Chemical Industry, Ltd.; solids concentration: 20%) were used instead of 20 parts of Silica Dispersion A used in Example I-1.

Comparative Example I-3

A heat-sensitive recording material was prepared in the same manner as in Example I-1, except that 5 parts of a 40% dispersion of kaolin (trade name: UW 90, manufactured by Engelhard Corporation) were used instead of 20 parts of Silica Dispersion A used in Example I-1.

Comparative Example I-4

A heat-sensitive recording material was prepared in the same manner as in Example I-1, except that 20 parts of Silica Dispersion G were used instead of 20 parts of Silica Dispersion A used in Example I-1.

Comparative Example I-5

A heat-sensitive recording material was prepared in the same manner as in Example I-1, except that 20 parts of Silica Dispersion H were used instead of 20 parts of Silica Dispersion A used in Example I-1.

Comparative Example I-6

A heat-sensitive recording material was prepared in the same manner as in Example I-1, except that 20 parts of Silica Dispersion J were used instead of 20 parts of Silica Dispersion A used in Example I-1.

The 19 types of heat-sensitive recording materials thus obtained were evaluated for the following characteristics. The results are shown in Table 1.

<Recording Density>

Each heat-sensitive recording material was subjected to color development at 0.24 mJ/dot using a thermal recording tester (trade name: TH-PMD, manufactured by OKURA DENKI) to record an image. The density of the recorded portion was measured with a Macbeth densitometer (trade name: RD-914, manufactured by Macbeth) in visual mode.

<Reduction in the Adhesion of Residue to the Thermal Head>

Each heat-sensitive recording material was subjected to color development at 0.40 mJ/dot using a thermal recording tester (trade name: TH-PMD, manufactured by OKURA DENKI), and the amount of residue adhered to the thermal head was visually examined and rated as follows:

A: Free of residue; no problem

B: Adhesion of a slight amount of residue; no practical problems

C: Adhesion of residue; problematic

<Ink Adhesion>

Each heat-sensitive recording material was printed with a 0.5 cc UV ink (trade name: Bestcure STP indigo blue W, manufactured by T&K Toka Co., Ltd.) using an RI printer (manufactured by Akira Seisakusho Corporation), and the printed heat-sensitive recording material was irradiated with ultraviolet light using a UV irradiator (trade name: "EYE GRANDAGE", manufactured by Eyegraphics, Co., Ltd.; lamp power: 1.5 kW; conveyor speed: 812 m/min) to cure the UV ink. A cellophane tape was applied to and peeled from the printed portion of the resulting heat-sensitive recording material, and the ink adhesion was rated as follows:

A: No peeling of the printed portion; excellent adhesion

B: Slight peeling of the printed portion; no practical problems

C: Peeling of the printed portion; lower adhesion

<Recording Density of the Printed Portion>

The printed portion of the heat-sensitive recording material obtained after the ink adhesion evaluation was subjected to color development at 0.24 mJ/dot using a thermal recording tester (trade name: TH-PMD, manufactured by OKURA DENKI) to record an image. The density of the recorded portion was measured with a Macbeth densitometer (trade name: RD-914, manufactured by Macbeth) in visual mode.

<Anti-Sticking Properties>

The printed portion of the heat-sensitive recording material obtained after the ink adhesion evaluation was subjected to color development at 0.24 mJ/dot using a thermal recording tester (trade name: TH-PMD, manufactured by OKURA DENKI), and the amount of residue adhered to the thermal head was visually examined and rated as follows:

A: Free of residue; no problem

B: Adhesion of a slight amount of residue; no practical problems

C: Adhesion of residue; problematic

<Plasticizer Resistance>

A wrap film (trade name: Hi-wrap KMA-W, manufactured by Mitsui Chemicals, Inc.) was wound around polycarbonate pipe (diameter: 40 mm) three times with, and the heat-sensitive recording material recorded under the recording density evaluation conditions was placed thereon. The same wrap film was further wound around the heat-sensitive recording material three times and left standing at 40° C. for 24 hours. The condition of the resulting recorded portion was visually examined and rated as follows:

A: Little color fading; no problem

B: Slight color fading; no practical problems

C: Considerable color fading; problematic

TABLE 1

| | Average particle diameter of secondary particles (nm) | Recording density | Reduction in the adhesion of residue to the thermal head | Ink adhesion | Recording density of the printed portion | Anti-sticking properties | Plasticizer resistance |
|---|---|---|---|---|---|---|---|
| Example I-1 | 80 | 1.56 | A | A | 2.10 | A | A |
| Example I-2 | 300 | 1.53 | A | A | 2.06 | A | A |
| Example I-3 | 500 | 1.52 | A | A | 2.06 | A | A |
| Example I-4 | 700 | 1.48 | A | A | 2.05 | A | A |
| Example I-5 | 900 | 1.45 | A | A | 1.99 | A | A |
| Example I-6 | 300 | 1.52 | A | A | 2.08 | A | A |
| Example I-7 | 300 | 1.53 | A | A | 2.06 | A | A |
| Example I-8 | 300 | 1.55 | B | B | 2.10 | B | A |
| Example I-9 | 300 | 1.53 | A | A | 2.06 | A | A |

TABLE 1-continued

| | Average particle diameter of secondary particles (nm) | Recording density | Reduction in the adhesion of residue to the thermal head | Ink adhesion | Recording density of the printed portion | Anti-sticking properties | Plasticizer resistance |
|---|---|---|---|---|---|---|---|
| Example I-10 | 300 | 1.53 | B | A | 2.08 | B | B |
| Example I-11 | 300 | 1.53 | A | B | 2.07 | A | A |
| Example I-12 | 300 | 1.46 | A | A | 2.01 | A | B |
| Example I-13 | 300 | 1.48 | A | A | 2.01 | A | A |
| Comparative Example I-1 | —* | 1.42 | B | C | 1.99 | C | B |
| Comparative Example I-2 | —** | 1.56 | C | C | 2.11 | C | A |
| Comparative Example I-3 | —*** | 1.42 | C | C | 2.00 | C | B |
| Comparative Example I-4 | 4500 | 1.40 | A | A | 1.97 | A | C |
| Comparative Example I-5 | 1000 | 1.42 | A | A | 1.98 | A | C |
| Comparative Example I-6 | 1200 | 1.42 | A | A | 1.98 | A | C |

*Aluminum hydroxide
**Colloidal silica
***Kaolin

As can be seen from Table 1, the heat-sensitive recording material according to the first embodiment of the invention exhibits reduced adhesion of residue to the thermal head, a good balance of recording sensitivity, anti-sticking properties and plasticizer resistance (anti-barrier properties), as well as excellent ink fixation properties.

Example II-1

Preparation of Undercoat Layer Coating Composition

A dispersion of 85 parts of calcined clay (trade name: Ansilex, manufactured by Engelhard Corporation) in 320 parts of water was mixed with 40 parts of a styrene-butadiene copolymer emulsion (solids content: 50%) and 50 parts of a 10% aqueous solution of oxidized starch, and the mixture was then stirred to give an undercoat layer coating composition.

<Preparation of Leuco Dye Dispersion (Dispersion (a))>

A composition comprising 10 parts of 3-(N-ethyl-N-iso-pentylamino)-6-methyl-7-anilinofluoran, 5 parts of a 5% aqueous solution of methylcellulose, and 15 parts of water was pulverized using a sand mill to an average particle diameter of 1.5 μm, thus giving a leuco dye dispersion (Dispersion (a)).

<Preparation of Developer Dispersion (Dispersion (b))>

A composition comprising 10 parts of 3,3'-diallyl-4,4'-dihydroxydiphenylsulfone, 5 parts of a 5% aqueous solution of methylcellulose, and 15 parts of water was pulverized using a sand mill to an average particle diameter of 1.5 μm, thus giving a developer dispersion (Dispersion (b)).

<Preparation of Sensitizer Dispersion (Dispersion (c))>

A composition comprising 20 parts of 1,2-di(3-methylphenoxy)ethane, 5 parts of a 5% aqueous solution of methylcellulose, and 55 parts of water was pulverized using a sand mill to an average particle diameter of 1.5 μm, thus giving a sensitizer dispersion (Dispersion (c)).

<Preparation of Heat-Sensitive Recording Layer Coating Composition>

A composition comprising 25 parts of Dispersion (a), 50 parts of Dispersion (b), 50 parts of Dispersion (c), 30 parts of a 20% aqueous solution of oxidized starch, 10 parts of light calcium carbonate, 50 parts of a 10% aqueous solution of polyvinyl alcohol, and 10 parts of water was mixed and stirred to give a heat-sensitive recording layer coating composition.

<Preparation of Protective Layer Coating Composition>

A composition comprising 450 parts of a 10% aqueous solution of acetoacetyl-modified polyvinyl alcohol (trade name: Gohsefimer Z-410, manufactured by Nippon Synthetic Chemical Industry Co., Ltd.; saponification degree: 98 mol %; polymerization degree: 2300), 40 parts of an acrylic resin (trade name: Polysol AM 2250, manufactured by Showa Highpolymer Co., Ltd.; Tg: 10° C.; solids concentration: 50%), 300 parts of Silica Dispersion A, 20 parts of a 25% dispersion of zinc stearate, and 190 parts of water was mixed and stirred to give a protective layer coating composition.

<Preparation of Heat-Sensitive Recording Material>

The undercoat layer coating composition was applied to one side of a 48 g/m$^2$ base paper in an amount of 9.0 g/m$^2$ on a dry weight basis and dried. The heat-sensitive recording layer coating composition was then applied to the undercoat layer in an amount of 5.0 g/m$^2$ on a dry weight basis and dried. The protective layer coating composition was then applied to the heat-sensitive recording layer in an amount of 1.5 g/m$^2$ on a dry weight basis (smaller than the amount of 2 g/m$^2$ used in the first embodiment) and dried. The paper thus coated was subsequently supercalendered to yield a heat-sensitive recording material having a smoothness of 1,000 to 4,000 seconds as measured by an Oken-type smoothness tester.

Example II-2

A heat-sensitive recording material was prepared in the same manner as in Example II-1, except that 300 parts of Silica Dispersion B were used instead of 300 parts of Silica Dispersion A used in Example II-1.

Example II-3

A heat-sensitive recording material was prepared in the same manner as in Example II-1, except that 300 parts of Silica Dispersion C were used instead of 300 parts of Silica Dispersion A used in Example II-1.

Example II-4

A heat-sensitive recording material was prepared in the same manner as in Example II-1, except that 300 parts of Silica Dispersion D were used instead of 300 parts of Silica Dispersion A used in Example II-1.

Example II-5

A heat-sensitive recording material was prepared in the same manner as in Example II-1, except that 300 parts of Silica Dispersion E were used instead of 300 parts of Silica Dispersion A used in Example II-1.

Example II-6

A heat-sensitive recording material was prepared in the same manner as in Example II-1, except that 300 parts of Silica Dispersion F were used instead of 300 parts of Silica Dispersion A used in Example II-1.

Example II-7

A heat-sensitive recording material was prepared in the same manner as in Example II-1, except that 150 parts of a commercially available silica dispersion (trade name: Sylojet 703A, manufactured by Grace Davison; concentration: 20%; average secondary particle diameter: 300 nm; average particle diameter of secondary particles: 300 nm; primary particle diameter: 11 nm; specific surface area: 280 $m^2/g$) were used instead of 300 parts of Silica Dispersion A used in Example II-1.

The "average secondary particle diameter" represents a value shown in the manufacturer's catalog. The "primary particle diameter" was determined in accordance with Equation (2) shown above, using the value of the specific surface area. The "average particle diameter of secondary particles" was determined by the procedure described in the section "average particle diameter of secondary particles" outlined above.

Example II-8

A heat-sensitive recording material was prepared in the same manner as in Example II-2, except that 450 parts of a 10% aqueous solution of acetoacetyl-modified polyvinyl alcohol (trade name: Gohsefimer Z-320, manufactured by Nippon Synthetic Chemical Industry Co., Ltd.; saponification degree: 92 mol %; polymerization degree: 2000) were used instead of 450 parts of the 10% aqueous solution of acetoacetyl-modified polyvinyl alcohol (trade name: Gohsefimer Z-410, manufactured by Nippon Synthetic Chemical Industry Co., Ltd.; saponification degree: 98 mol %; polymerization degree: 2300) used in Example II-2.

Example II-9

A heat-sensitive recording material was prepared in the same manner as in Example II-2, except that the protective layer was applied in an amount of 2.5 $g/m^2$ instead of 1.5 $g/m^2$.

Comparative Example II-1

A heat-sensitive recording material was prepared in the same manner as in Example II-1, except that 20 parts of Silica Dispersion G were used instead of 20 parts of Silica Dispersion A.

Comparative Example II-2

A heat-sensitive recording material was prepared in the same manner as in Example II-2, except that 450 parts of a 10% aqueous solution of acetoacetyl-modified polyvinyl alcohol (trade name: Gohsefimer Z-100, manufactured by Nippon Synthetic Chemical Industry Co., Ltd.; saponification degree: 98 mol %; polymerization degree: 450) were used instead of 450 parts of the 10% aqueous solution of acetoacetyl-modified polyvinyl alcohol (trade name: Gohsefimer Z-410, manufactured by Nippon Synthetic Chemical Industry Co., Ltd.; saponification degree: 98 mol %; polymerization degree: 2300).

Comparative Example II-3

A heat-sensitive recording material was prepared in the same manner as in Example II-1, except that 5 parts of a 40% aqueous dispersion of kaolin (trade name: UW 90; manufactured by Engelhard Corporation) were used instead of 20 parts of Silica Dispersion A.

Comparative Example II-4

A heat-sensitive recording material was prepared in the same manner as in Example II-1, except that 20 parts of Silica Dispersion H were used instead of 20 parts of Silica Dispersion A.

Comparative Example II-5

A heat-sensitive recording material was prepared in the same manner as in Example II-1, except that 20 parts of Silica Dispersion I were used instead of 20 parts of Silica Dispersion A.

Comparative Example II-6

A heat-sensitive recording material was prepared in the same manner as in Example II-1, except that 300 parts of Silica Dispersion J were used instead of 300 parts of Silica Dispersion A.

The 15 types of heat-sensitive recording materials thus obtained were evaluated for the following characteristics. The results are shown in Table 2.

<Recording Density>

Using a thermal recording tester (trade name: Barlabe 300, manufactured by Sato Corporation), each heat-sensitive recording material was subjected to recording at a speed of 4 in/sec and a strobe of 2400 to form solid pattern, and the density of the recorded portion was measured with a Macbeth densitometer (trade name: RD-914, manufactured by Macbeth) in visual mode.

<Reduction in the Adhesion of Residue to the Thermal Head>

Using a thermal recording tester (trade name: Barlabe 300, manufactured by Sato Corporation), each heat-sensitive recording material was subjected to recording to a length of 5 m to form a 5 m solid pattern thereon at a speed of 4 in/sec and a strobe of 4000, and the amount of residue adhered to the thermal head was visually examined and rated as follows:

A: Free of residue; no problem

B: Adhesion of a slight amount of residue; no practical problems

C: Adhesion of residue; problematic

<Anti-Sticking Properties>

Using a thermal recording tester (trade name: Barlabe 300, manufactured by Sato Corporation), each heat-sensitive recording material was subjected to recording at a speed of 4 in/sec and a strobe of 2400 to form solid pattern, and the noise generated during recording was examined and rated as follows:

A: No sticking noise

B: Low sticking noise

C: Loud sticking noise

<Barrier Properties>

A wrap film (trade name: Hi-wrap KMA-W, manufactured by Mitsui Chemicals, Fabro, Inc.) was wound around a polycarbonate pipe (diameter: 40 mm) three times, and the heat-sensitive recording material recorded under the recording density evaluation conditions was placed thereon. The same wrap film was further wound around the heat-sensitive recording material three times and left standing at 40° C. for 24 hours. The condition of the resulting recorded portion was visually examined and rated as follows:

A: Little color fading; no problem

B: Slight color fading; no practical problems

C: Considerable color fading; problematic

TABLE 2

| | Average particle diameter of secondary particles (nm) | Recording density | Reduction in the adhesion of residue to the thermal head | Anti-sticking properties | Barrier properties |
|---|---|---|---|---|---|
| Example II-1 | 80 | 1.44 | A | A | A |
| Example II-2 | 300 | 1.44 | A | A | A |
| Example II-3 | 500 | 1.44 | A | A | A |
| Example II-4 | 700 | 1.40 | A | A | A |
| Example II-5 | 900 | 1.31 | A | A | B |
| Example II-6 | 900 | 1.30 | B | B | B |
| Example II-7 | 300 | 1.44 | A | A | A |
| Example II-8 | 300 | 1.44 | A | A | A |
| Example II-9 | 300 | 1.28 | A | A | A |
| Comparative Example II-1 | 4500 | 1.11 | A | A | C |
| Comparative Example II-2 | 300 | 1.44 | A | A | C |
| Comparative Example II-3 | —* | 1.40 | C | C | A |
| Comparative Example II-4 | 1000 | 1.20 | A | A | C |
| Comparative Example II-5 | 1000 | 1.20 | B | B | C |
| Comparative Example II-6 | 1200 | 1.19 | B | B | C |

*kaolin

As can be seen from Table 2, the heat-sensitive recording material according to the second embodiment of the invention exhibits reduction in sticking to such an extent that substantially or practically no problems arise, reduced adhesion of residue to the thermal head, high recording sensitivity, and plasticizer resistance (barrier properties) higher than that according to the first embodiment. The heat-sensitive recording material according to the second embodiment is thus especially suitable for use in the medical institutions, libraries, etc.

The invention claimed is:

1. A heat-sensitive recording material comprising:

a support;

a heat-sensitive recording layer comprising a leuco dye and a developer; and a protective layer principally comprising a pigment and a binder, wherein the binder comprises an acrylic resin in a proportion of 10 to 70 mass % relative to total solids of the protective layer;

the support, the heat-sensitive recording layer, and the protective layer being provided in this order;

the pigment in the protective layer comprising secondary particles with an average particle diameter of 30 to 900 nm formed by aggregation of amorphous silica primary particles with a particle diameter of 3 to 70 nm.

2. A heat-sensitive recording material according to claim 1, wherein the secondary particles are present in a proportion of 1 to 40 mass % relative to total solids of the protective layer.

3. A heat-sensitive recording material according to claim 1, wherein the protective layer further comprises at least one pigment selected from the group consisting of kaolin, light calcium carbonate, ground calcium carbonate, calcined kaolin, titanium oxide, magnesium carbonate, aluminum hydroxide, colloidal silica, synthetic layered mica, and plastic pigments such as urea-formalin resin fillers.

4. A heat-sensitive recording material according to claim 1, wherein the acrylic resin is a copolymer of (a) (meth)acrylonitrile and (b) a vinyl monomer copolymerizable with (meth) acrylonitrile.

5. A heat-sensitive recording material according to claim 1, wherein the acrylic resin is a copolymer of (xi) at least one monomer selected from the group consisting of acrylonitrile and methacrylonitrile and (iii) at least one monomer selected from the group consisting of alkyl or hydroxyalkyl esters of acrylic acid and methacrylic acid, the copolymer having a glass transition temperature Tg of −10 to 100° C., or a copolymer of (xi) at least one monomer selected from the group consisting of acrylonitrile and methacrylonitrile, (iii) at least one monomer selected from the group consisting of alkyl or hydroxyalkyl esters of acrylic acid and methacrylic acid, (i) at least one monomer selected from the group consisting of acrylic acid and methacrylic acid, and (vi) at least one monomer selected from the group consisting of acrylamide, methacrylamide, N-methylolacrylamide, N-methylolmethacrylamide, and like acrylamide compounds, the copolymer having a glass transition temperature Tg of 30 to 100° C.

6. A heat-sensitive recording material according to claim 1, wherein the binder of the protective layer further comprises a water-soluble resin.

7. A heat-sensitive recording material according to claim 6, wherein the water-soluble resin is a polyvinyl alcohol or a modified polyvinyl alcohol, the polyvinyl alcohol or modified polyvinyl alcohol being present in a proportion of 25 to 600 mass % based on total solids of the acrylic resin.

8. A heat-sensitive recording material according to claim 6, wherein the water-soluble resin is acetoacetyl-modified polyvinyl alcohol with a polymerization degree of 500 to 1900.

9. A beat-sensitive recording material according to claim 6, wherein the water-soluble resin is diacetone-modified polyvinyl alcohol.

10. A heat-sensitive recording material according to claim 1, wherein the heat-sensitive recording material has, a printed portion.

11. A heat-sensitive recording material according to claim 1, further comprising an undercoat layer between the support and the heat-sensitive recording layer.

12. A heat-sensitive recording material comprising:

a support;

a heat-sensitive recording layer comprising a leuco dye and a developer; and a protective layer principally comprising a pigment, a binder and an acrylic resin in a proportion of 5 to 40 mass % relative to total solids of the protective layer;

the support, the heat-sensitive recording layer, and the protective layer being provided in this orders the pigment of the protective layer comprising secondary particles with an average particle diameter of 30 to 900 nm formed by aggregation of amorphous silica primary particles with a particle diameter of 3 to 70 nm;

the binder in the protective layer comprising acetoacetyl-modified polyvinyl alcohol with a saponification degree of 90 to 100 mol % and a polymerization degree of 1900 to 5000.

13. A heat-sensitive recording material according to claim 12, wherein the secondary particles are present in a proportion of 10 to 40 mass % relative to total solids of the protective layer.

14. A heat-sensitive recording material according to claim 12, wherein the acetoacetyl-modified polyvinyl alcohol is present in a proportion of 30 to 80 mass % relative to total solids of the protective layer.

15. A heat-sensitive recording material according to claim 12, wherein the acrylic resin is a copolymer of (xi) at least one monomer selected from the group consisting of acrylonitrile and methacrylonitrile; and (iii) at least one monomer selected from the group consisting of alkyl esters or hydroxyalkyl esters of acrylic acid and methacrylic acid, the copolymer having a glass transition temperature Tg of −10 to 100° C., or a copolymer of (xi) at least one monomer selected from the group consisting of acrylonitrile and methacrylonitrile, (iii) at least one monomer selected from the group consisting of alkyl or hydroxyalkyl esters of acrylic acid and methacrylic acid, (i) at least one monomer selected from the group consisting of acrylic acid and methacrylic acid, and (vi) at least one monomer selected from the group consisting of acrylamide, methacrylamide, N-methylolacrylamide, methylolmethacrylamide, and like acrylamide compounds, the copolymer having a glass transition temperature Tg of 30 to 100° C.

16. A heat-sensitive recording material according to claim 12, wherein the protective layer further comprises zinc stearate in a proportion of 2 to 7.5 mass % relative to total solids of the protective layer.

17. A heat-sensitive recording material according to claim 12, wherein the protective layer is applied in an amount of 0.3 to 2.5 g/m2.

18. A heat-sensitive recording material according to claim 12, further comprising an undercoat layer between the support and the heat-sensitive recording layer.

* * * * *